US011315468B2

(12) United States Patent
Zhang et al.

(10) Patent No.: US 11,315,468 B2
(45) Date of Patent: Apr. 26, 2022

(54) PIXEL DRIVING CIRCUIT INCLUDING FIRST THIN FILM TRANSISTOR, AND DISPLAY DEVICE INCLUDING THE SAME

(71) Applicant: SHENZHEN CHINA STAR OPTOELECTRONICS SEMICONDUCTOR DISPLAY TECHNOLOGY CO., LTD., Shenzhen (CN)

(72) Inventors: Xiaodong Zhang, Shenzhen (CN); Baixiang Han, Shenzhen (CN)

( * ) Notice: Subject to any disclaimer, the term of this patent is extended or adjusted under 35 U.S.C. 154(b) by 207 days.

(21) Appl. No.: 16/620,504

(22) PCT Filed: Nov. 4, 2019

(86) PCT No.: PCT/CN2019/115214
§ 371 (c)(1),
(2) Date: Dec. 8, 2019

(87) PCT Pub. No.: WO2021/051490
PCT Pub. Date: Mar. 25, 2021

(65) Prior Publication Data

US 2021/0335190 A1 Oct. 28, 2021

(30) Foreign Application Priority Data

Sep. 16, 2019 (CN) ..... 201910872967.1

(51) Int. Cl.
*G09G 3/20* (2006.01)
*G09G 3/32* (2016.01)

(52) U.S. Cl.
CPC ..... *G09G 3/2007* (2013.01); *G09G 3/32* (2013.01); *G09G 2300/0852* (2013.01); *G09G 2310/027* (2013.01); *G09G 2310/06* (2013.01); *G09G 2320/0252* (2013.01)

(58) Field of Classification Search
None
See application file for complete search history.

(56) References Cited

U.S. PATENT DOCUMENTS

2013/0127818 A1 5/2013 Tsai
2015/0379923 A1* 12/2015 Lee ..... H01L 27/3272 345/206
2016/0086544 A1* 3/2016 Park ..... G09G 3/3233 345/690
2017/0103703 A1* 4/2017 Bi ..... G09G 3/3291
(Continued)

FOREIGN PATENT DOCUMENTS

CN 102436793 A 5/2012
CN 109036285 A 12/2018
(Continued)

*Primary Examiner* — Chad M Dicke

(57) ABSTRACT

A pixel driving circuit and a display device are provided. The pixel driving circuit includes a data writing unit, a driving unit, a compensating unit, and a light emitting unit. A first capacitor is provided in the driving unit. A first thin film transistor is provided between the micro light emitting diode and the driving unit. Reduce a transmission efficiency of the driving unit in different gray scale by a capacitance coupling effect of the first capacitor to the driving unit. Enhance an ability of gray scale switching of the pixel driving circuit. Improve a display effect of a display device.

6 Claims, 4 Drawing Sheets

(56) References Cited

U.S. PATENT DOCUMENTS

| | | | | |
|---|---|---|---|---|
| 2017/0116925 | A1* | 4/2017 | Lee | G11C 19/28 |
| 2020/0074919 | A1 | 3/2020 | Hung et al. | |

FOREIGN PATENT DOCUMENTS

| | | | |
|---|---|---|---|
| CN | 109272936 | A | 1/2019 |
| CN | 109584786 | A | 4/2019 |
| CN | 109584788 | A | 4/2019 |

* cited by examiner

| Item | 4T2C embodiment | | Traditional 3T1C | |
|---|---|---|---|---|
| Gray | Vdata | DTE | Vdata | DTE |
| 255 | 7.10 | 12.5% | 3.00 | 36% |
| 224 | 7.00 | 11.0% | 2.96 | 35% |
| 192 | 6.90 | 9.3% | 2.91 | 28% |
| 160 | 6.78 | 9.5% | 2.84 | 30% |
| 128 | 6.60 | 7.8% | 2.81 | 30% |
| 96 | 6.50 | 8.0% | 2.71 | 24.8% |
| 64 | 6.41 | 8.2% | 2.62 | 17.8% |
| 32 | 6.15 | 5.6% | 2.56 | 21% |
| 0 | 6.02 | 4.9% | 2.53 | 18.1% |
| | Vini=1.5v | | | |

FIG. 4

PIXEL DRIVING CIRCUIT INCLUDING FIRST THIN FILM TRANSISTOR, AND DISPLAY DEVICE INCLUDING THE SAME

FIELD

The present disclosure relates to display technologies, and more particularly, to a pixel driving circuit and a display device.

BACKGROUND

Micro light emitting diode display (Micro-LED) is a high-density integrated LED array display device compared to liquid crystal display (LCD) technology and organic light emitting diode (OLED) display device technology. The Micro-LED has higher luminous efficiency and lower power consumption, and has the advantages of long life and fast response.

A traditional 3T1C pixel driving circuit has been widely used in OLED displays. For the driving transistor, a current through the driving transistor determines brightness of the OLED or Micro-LED. Magnitude of the current is related to a voltage difference Vgs between a gate and a source of the driving transistor. A difference in the magnitude of the voltage difference produces a different gray scale display. Because the micro-LED has higher luminous efficiency and brightness than the OLED, for the driving transistor, a small variation range of the voltage difference achieves higher brightness. A small variation range of the high-low gray-scale switching voltage difference requires data signals with higher precision.

In summary, the pixel driving circuit of the existing Micro-LED display device has a problem that a high-low gray-scale switching capability is weak. Therefore, there is a need to provide a pixel driving circuit and display device to solve the above issues.

SUMMARY

In view of the above, the present disclosure provides a pixel driving circuit and a display device to resolve an issue that a high-low gray-scale switching capability of a pixel driving circuit of a Micro-LED display device is weak.

In order to achieve above-mentioned object of the present disclosure, one embodiment of the disclosure provides a pixel driving circuit, including a data writing unit, a driving unit, a compensating unit, and a light emitting unit.

The data writing unit is configured to receive a data voltage signal and a first scanning signal and connected to the driving unit through a first node.

The driving unit is configured to receive a power high level signal and connected to the compensating unit through a second node.

The light emitting unit is configured to receive a light emitting signal and a power low level signal and connected to the driving unit through a third node.

The driving unit includes a first capacitor, a first end of the first capacitor is configured to receive the power high level signal, a second end of the first capacitor is connected to the second node, the light emitting unit includes a first thin film transistor and a micro light emitting diode, a gate of the first thin film transistor is configured to receive the light emitting signal, a source of the first thin film transistor is connected to the third node, and a drain of the first thin film transistor is connected to a first end of the micro light emitting diode.

In one embodiment of the pixel driving circuit of the disclosure, the data writing unit includes a second thin film transistor, a gate of the second thin film transistor is configured to receive the first scanning signal, a source of the second thin film transistor is configured to receive the data voltage signal, and a drain of the second thin film transistor is connected to the first node.

In one embodiment of the pixel driving circuit of the disclosure, the driving unit further includes a third thin film transistor and a storage capacitor, a gate of the third thin film transistor is connected to the first node, a source of the third thin film transistor is configured to receive the power high level signal, a drain of the third thin film transistor is connected to the third node, a first end of the storage capacitor is connected to the first node, and a second end of the storage capacitor is connected to the second node.

In one embodiment of the pixel driving circuit of the disclosure, the compensating unit is configured to receive a second scanning signal and connected to a sensing circuit, the sensing circuit is configured to provide a sensing voltage signal to transmit to the third thin film transistor by the compensating unit for sensing a threshold voltage of the third thin film transistor, and compensating the threshold voltage.

In one embodiment of the pixel driving circuit of the disclosure, the compensating unit includes a fourth thin film transistor, a gate of the fourth thin film transistor is configured to receive the second scanning signal, a source of the fourth thin film transistor is connected to the sensing circuit, and a drain of the fourth thin film transistor is connected to the second node.

In one embodiment of the pixel driving circuit of the disclosure, all the first thin film transistor, the second thin film transistor, the third thin film transistor, and the fourth thin film transistor are N type transistors.

In one embodiment of the pixel driving circuit of the disclosure, a driving sequence of the pixel driving circuit includes a first phase, a second phase, and a third phase.

The second thin film transistor and the fourth thin film transistor are turned on by the first scanning signal and the second scanning signal respectively, and the data voltage signal and the sensing voltage signal are written in the first phase.

The second thin film transistor and the fourth thin film transistor are turned off by the first scanning signal and the second scanning signal respectively, and the driving unit is under a capacitance coupling effect in the second phase.

The third thin film transistor is turned on, the first thin film transistor is turned on by the light emitting signal, and the driving unit provides a driving current to drive the micro light emitting diode to emit light.

In one embodiment of the pixel driving circuit of the disclosure, all the first scanning signal, the second scanning signal, the data voltage signal, and the sensing voltage signal are high-level signals, and the light emitting signal is a low-level signal in the first phase.

All the first scanning signal, the second scanning signal, and the light emitting signal are the low-level signals, the data voltage signal includes the high-level signal and the low-level signal, and the sensing voltage signal includes the high-level signal and the low-level signal in the second phase.

All the first scanning signal, the second scanning signal, the data voltage signal, and the sensing voltage signal are the low-level signals, and the light emitting signal is the high-level signal in the third phase.

In one embodiment of the pixel driving circuit of the disclosure, a sequence of the data voltage signal and a sequence of the sensing voltage signal are the same, and a sequence of the first scanning signal and a sequence of the second scanning signal are the same.

Furthermore, another embodiment of the disclosure provides a display device, including a pixel driving circuit, wherein the pixel driving circuit includes a data writing unit, a driving unit, a compensating unit, and a light emitting unit.

The data writing unit is configured to receive a data voltage signal and a first scanning signal and connected to the driving unit through a first node.

The driving unit is configured to receive a power high level signal and connected to the compensating unit through a second node.

The light emitting unit is configured to receive a light emitting signal and a power low level signal and connected to the driving unit through a third node.

The driving unit includes a first capacitor, a first end of the first capacitor is configured to receive the power high level signal, a second end of the first capacitor is connected to the second node, the light emitting unit includes a first thin film transistor and a micro light emitting diode, a gate of the first thin film transistor is configured to receive the light emitting signal, a source of the first thin film transistor is connected to the third node, and a drain of the first thin film transistor is connected to a first end of the micro light emitting diode.

In one embodiment of the display device of the disclosure, the data writing unit includes a second thin film transistor, a gate of the second thin film transistor is configured to receive the first scanning signal, a source of the second thin film transistor is configured to receive the data voltage signal, and a drain of the second thin film transistor is connected to the first node.

In one embodiment of the display device of the disclosure, the driving unit further includes a third thin film transistor and a storage capacitor, a gate of the third thin film transistor is connected to the first node, a source of the third thin film transistor is configured to receive the power high level signal, a drain of the third thin film transistor is connected to the third node, a first end of the storage capacitor is connected to the first node, and a second end of the storage capacitor is connected to the second node.

In one embodiment of the display device of the disclosure, the compensating unit is configured to receive a second scanning signal and connected to a sensing circuit, the sensing circuit is configured to provide a sensing voltage signal to transmit to the third thin film transistor by the compensating unit for sensing a threshold voltage of the third thin film transistor, and compensating the threshold voltage.

In one embodiment of the display device of the disclosure, the compensating unit includes a fourth thin film transistor, a gate of the fourth thin film transistor is configured to receive the second scanning signal, a source of the fourth thin film transistor is connected to the sensing circuit, and a drain of the fourth thin film transistor is connected to the second node.

In one embodiment of the display device of the disclosure, all the first thin film transistor, the second thin film transistor, the third thin film transistor, and the fourth thin film transistor are N type transistors.

In one embodiment of the display device of the disclosure, a driving sequence of the pixel driving circuit includes a first phase, a second phase, and a third phase.

The second thin film transistor and the fourth thin film transistor are turned on by the first scanning signal and the second scanning signal respectively, and the data voltage signal and the sensing voltage signal are written in the first phase.

The second thin film transistor and the fourth thin film transistor are turned off by the first scanning signal and the second scanning signal respectively, and the driving unit is under a capacitance coupling effect in the second phase.

The third thin film transistor is turned on, the first thin film transistor is turned on by the light emitting signal, and the driving unit provides a driving current to drive the micro light emitting diode to emit light.

In one embodiment of the display device of the disclosure, all the first scanning signal, the second scanning signal, the data voltage signal, and the sensing voltage signal are high-level signals, and the light emitting signal is a low-level signal in the first phase.

All the first scanning signal, the second scanning signal, and the light emitting signal are the low-level signals, the data voltage signal includes the high-level signal and the low-level signal, and the sensing voltage signal includes the high-level signal and the low-level signal in the second phase.

All the first scanning signal, the second scanning signal, the data voltage signal, and the sensing voltage signal are the low-level signals, and the light emitting signal is the high-level signal in the third phase.

In one embodiment of the display device of the disclosure, a sequence of the data voltage signal and a sequence of the sensing voltage signal are the same, and a sequence of the first scanning signal and a sequence of the second scanning signal are the same.

Furthermore, another embodiment of the disclosure provides a display device, including a pixel driving circuit, wherein the pixel driving circuit includes a data writing unit, a driving unit, a compensating unit, and a light emitting unit.

The data writing unit is configured to receive a data voltage signal and a first scanning signal and connected to the driving unit through a first node.

The driving unit is configured to receive a power high level signal and connected to the compensating unit through a second node.

The light emitting unit is configured to receive a light emitting signal and a power low level signal and connected to the driving unit through a third node.

The light emitting unit includes a first thin film transistor and a micro light emitting diode, a gate of the first thin film transistor is configured to receive the light emitting signal, a source of the first thin film transistor is connected to the third node, a drain of the first thin film transistor is connected to a first end of the micro light emitting diode, the data writing unit includes a second thin film transistor, a gate of the second thin film transistor is configured to receive the first scanning signal, a source of the second thin film transistor is configured to receive the data voltage signal, the driving unit includes a first capacitor and a third thin film transistor, a drain of the second thin film transistor is connected to a gate of the third thin film transistor through the first node, a first end of the first capacitor is configured to receive the power high level signal, and a second end of the first capacitor is connected to the second node.

In one embodiment of the display device of the disclosure, the driving unit further includes a storage capacitor, a first end of the storage capacitor is connected to the first node, and a second end of the storage capacitor is connected to the second node.

In comparison with prior art, the pixel driving circuit of the disclosure provides the data writing unit, the driving unit, the compensating unit, and the light emitting unit. The first capacitor is provided in the driving unit. A first end of the first capacitor is configured to receive the power high level signal, and a second end of the first capacitor is connected to the second node. Reduce a data transmission efficiency of the driving unit in different gray scale by a capacitance coupling effect of the first capacitor to the driving unit. Achieve a high-low gray-scale switching by a lower data transmission efficiency to enhance an ability of high-low gray scale switching of the pixel driving circuit. Provide a first thin film transistor between the micro light emitting diode of the light emitting unit and the driving unit. The gate of the first thin film transistor is received the light emitting signal. The drain of the first thin film transistor is connected to the first end of the micro light emitting diode to ensure a current fluctuation of the driving unit not to affect the micro light emitting diode before lighting and to improve a display effect of a display device.

BRIEF DESCRIPTION OF DRAWINGS

FIG. 4 is a table of a detecting result of a pixel driving circuit according to an embodiment of the present disclosure.

DETAILED DESCRIPTION

The following description of the embodiments is provided by reference to the drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

Figure 1:
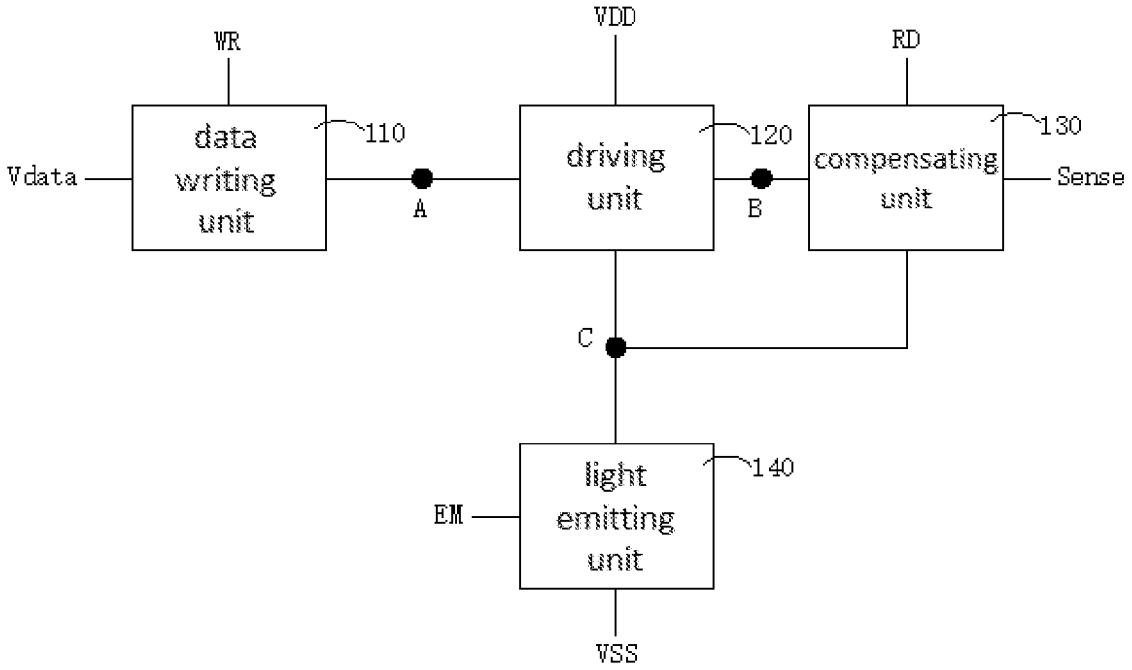
FIG. 1 is a schematic block diagram of a pixel driving circuit according to an embodiment of the present disclosure.
Figure 2:
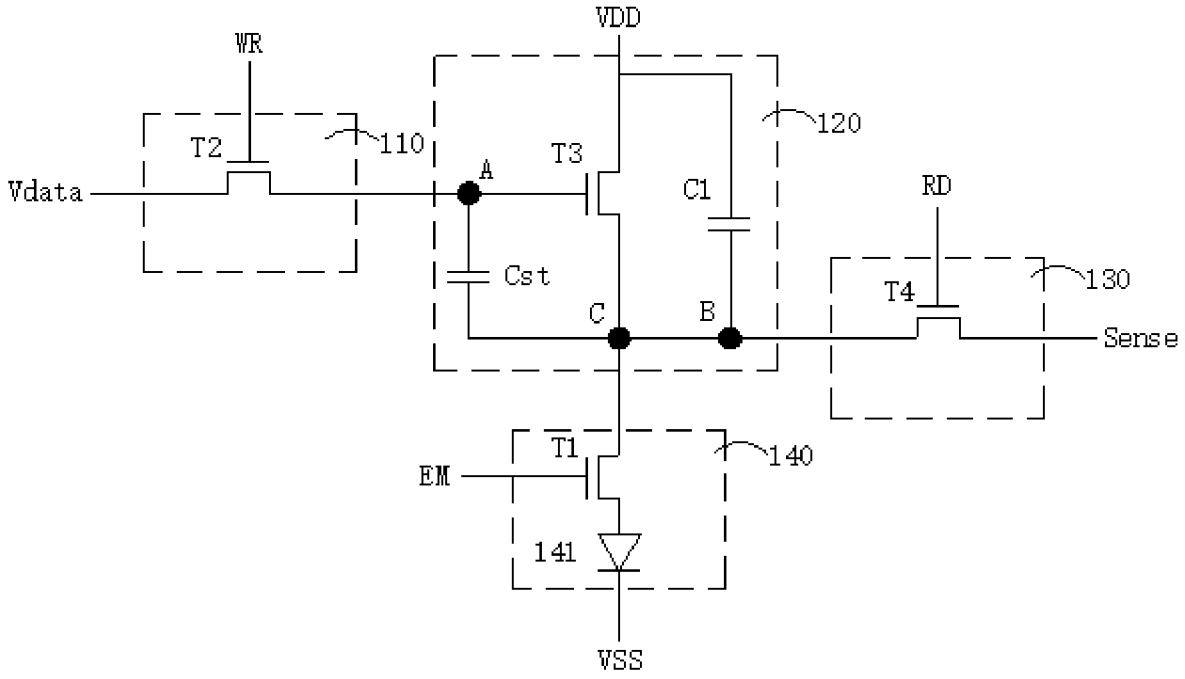
FIG. 2 is a schematic view of a structure of a pixel driving circuit according to an embodiment of the present disclosure.
Figure 3:
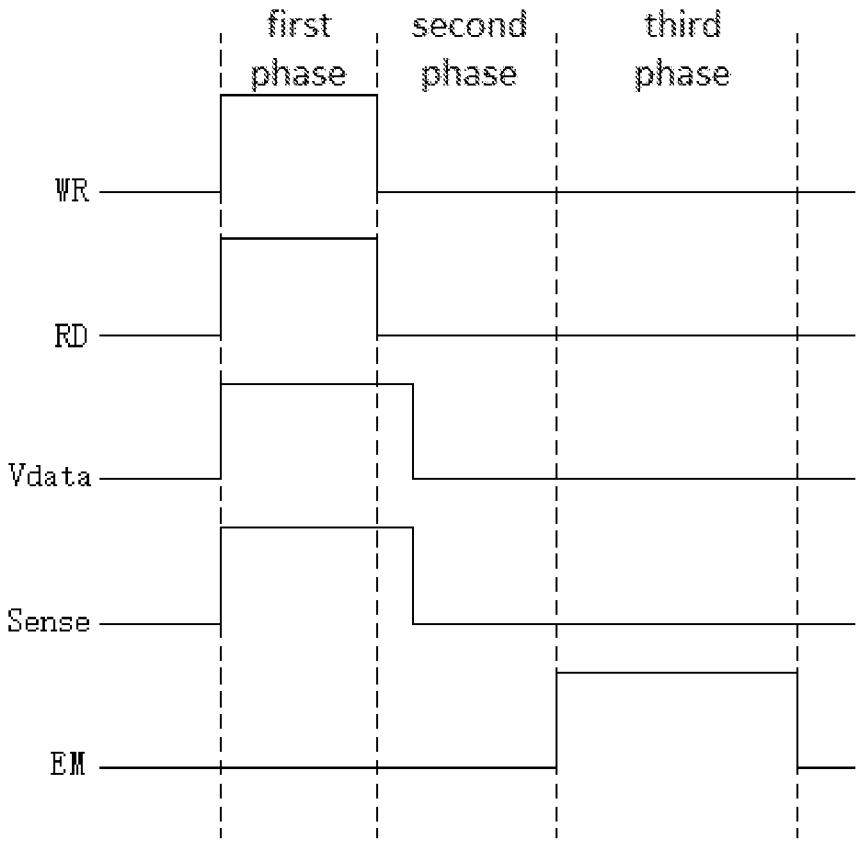
FIG. 3 is a schematic view of a sequence of a pixel driving circuit according to an embodiment of the present disclosure.

Referring to FIG. 1 to FIG. 3, one embodiment of the disclosure provides a pixel driving circuit, including a data writing unit, a driving unit, a compensating unit, and a light emitting unit.

Referring to FIG. 1, FIG. 1 is a schematic block diagram of a pixel driving circuit according to an embodiment of the present disclosure. The pixel driving circuit includes a data writing unit 110, a driving unit 120, a compensating unit 130, and a light emitting unit 140. The data writing unit 110 is configured to receive a data voltage signal Vdata and a first scanning signal WR and connected to the driving unit 120 through a first node A. The driving unit 120 is configured to receive a power high level signal VDD and connected to the compensating unit 130 through a second node B. The compensating unit 130 is configured to receive a second scanning signal RD and connected to a sensing circuit Sense. The light emitting unit 140 is configured to receive a light emitting signal EM and a power low level signal VSS and connected to the driving unit 120 through a third node C.

Referring to FIG. 2, the driving unit 120 includes a first capacitor C1, a first end of the first capacitor C1 is configured to receive the power high level signal VDD, a second end of the first capacitor C1 is connected to the second node B, the light emitting unit 140 includes a first thin film transistor T1 and a micro light emitting diode 141, a gate of the first thin film transistor T1 is configured to receive the light emitting signal EM, a source of the first thin film transistor T1 is connected to the third node C, and a drain of the first thin film transistor T1 is connected to a first end of the micro light emitting diode 141. A second end of the micro light emitting diode 141 is received the power low level signal VSS.

In one embodiment of the pixel driving circuit of the disclosure, the data writing unit 110 includes a second thin film transistor T2, a gate of the second thin film transistor T2 is configured to receive the first scanning signal WR, a source of the second thin film transistor T2 is configured to receive the data voltage signal Vdata, and a drain of the second thin film transistor T2 is connected to the first node A.

In one embodiment of the pixel driving circuit of the disclosure, the driving unit 120 further includes a third thin film transistor T3 and a storage capacitor Cst, a gate of the third thin film transistor T3 is connected to the first node A, a source of the third thin film transistor T3 is configured to receive the power high level signal VDD, a drain of the third thin film transistor T3 is connected to the third node C, a first end of the storage capacitor Cst is connected to the first node A, and a second end of the storage capacitor Cst is connected to the second node B.

Referring to FIG. 2, in one embodiment of the pixel driving circuit of the disclosure, the compensating unit 130 is configured to receive a second scanning signal RD and connected to a sensing circuit Sense, the sensing circuit Sense is configured to provide a sensing voltage signal Vini to transmit to the third thin film transistor T3 by the compensating unit 130 for sensing a threshold voltage of the third thin film transistor T3, and compensating the threshold voltage.

In detail, the compensating unit 130 includes a fourth thin film transistor T4, a gate of the fourth thin film transistor T4 is configured to receive the second scanning signal RD, a source of the fourth thin film transistor T4 is connected to the sensing circuit Sense, and a drain of the fourth thin film transistor T4 is connected to the second node B.

In one embodiment of the pixel driving circuit of the disclosure, all the first thin film transistor T1, the second thin film transistor T2, the third thin film transistor T3, and the fourth thin film transistor T4 are N type transistors.

Referring to FIG. 3, FIG. 3 is a schematic view of a sequence of a pixel driving circuit according to an embodiment of the present disclosure. In one embodiment of the pixel driving circuit of the disclosure, a driving sequence of the pixel driving circuit includes a first phase, a second phase, and a third phase. The second thin film transistor T2 and the fourth thin film transistor T4 are turned on by the first scanning signal WR and the second scanning signal RD respectively, and the data voltage signal Vdata and the sensing voltage signal Vini are written in the first phase. The second thin film transistor T2 and the fourth thin film transistor T4 are turned off by the first scanning signal WR and the second scanning signal RD respectively, and the driving unit 120 is under a capacitance coupling effect in the second phase. A voltage difference Vgs between a gate and a source of the third thin film transistor T3 raises to near a stable value by the capacitance coupling effect of storage capacitor Cst and the first capacitor C1. The third thin film transistor T3 is turned on when the voltage difference Vgs of the third thin film transistor T3 raises to near the stable value, the first thin film transistor T1 is turned on by the light emitting signal EM, and the driving unit 120 provides a driving current to drive the micro light emitting diode 141 in the light emitting unit 140 to emit light.

In one embodiment of the pixel driving circuit of the disclosure, all the first scanning signal WR, the second scanning signal RD, the data voltage signal Vdata, and the sensing voltage signal Vini of the sensing circuit Sense are high-level signals, and the light emitting signal EM is a low-level signal in the first phase. The second thin film transistor T2 is turned on to provide the data voltage signal Vdata to the gate of the third thin film transistor T3. The fourth thin film transistor T4 is turned on to provide the sensing voltage signal Vini to the third thin film transistor T3 to charge the storage capacitor Cst and the first capacitor C1 respectively.

All the first scanning signal WR, the second scanning signal RD, and the light emitting signal EM are the low-level signals, the data voltage signal Vdata includes the high-level signal and the low-level signal, and the sensing voltage signal Vini includes the high-level signal and the low-level signal in the second phase. In detail, the data voltage signal Vdata is keeping at high level and then turns to low level in the second phase. The sensing voltage signal Vini is keeping at high level and then turns to low level in the second phase. The second thin film transistor T2 and the fourth thin film transistor T4 are turned off. In order to keep an electrical potential of the gate of the third thin film transistor T3, the data voltage signal Vdata and the sensing voltage signal Vini are both keeping at high level then turn to low level. A voltage of the gate of the third thin film transistor T3 gradually raises and a voltage of the source of the third thin film transistor T3 gradually declines because of the capacitance coupling effect of storage capacitor Cst and the first capacitor C1. The voltage difference Vgs between a gate and a source of the third thin film transistor T3 gradually raises to near the stable value.

All the first scanning signal WR, the second scanning signal RD, the data voltage signal Vdata, and the sensing voltage signal Vini are the low-level signals, and the light emitting signal EM is the high-level signal in the third phase.

A data transmission efficiency is a rate of Vgs when lighting at the third phase to Vgs at a data written phase. Comparing to traditional 3T1C pixel driving circuit, the first capacitor C1 and the first thin film transistor T1 form a 4T2C pixel driving circuit. Referring to FIG. 4, FIG. 4 is a table of a detecting result of a pixel driving circuit according to an embodiment of the present disclosure. The pixel driving circuit of the embodiment of the disclosure have data transmission efficiency are less than a data transmission efficiency of traditional 3T1C pixel driving circuit. A high-low gray scale switching can realize at 7.10V-6.02V in a small data transmission efficiency design of the embodiment. A change of Vgs of 0.1V at a low gray scale region can achieve a good gray scale switching, but a change of Vgs must be small than 0.03V to realize the gray scale switching for a high data transmission efficiency design. Higher accuracy of the data voltage signal Vdata is required at the low gray scale region. The embodiment of the disclosure enlarges a gray scale voltage by data transmission efficiency can switch the gray scale better, and improve a display effect of a display device.

Referring to FIG. 3, in one embodiment of the pixel driving circuit of the disclosure, a sequence of the data voltage signal Vdata and a sequence of the sensing voltage signal Vini are the same, and a sequence of the first scanning signal WR and a sequence of the second scanning signal RD are the same.

Furthermore, another embodiment of the disclosure provides a pixel driving circuit. The pixel driving circuit includes a data writing unit, a driving unit, a compensating unit, and a light emitting unit. The first capacitor is provided in the driving unit. A first end of the first capacitor is configured to receive the power high level signal, and a second end of the first capacitor is connected to the second node. Reduce a data transmission efficiency of the driving unit in different gray scale by a capacitance coupling effect of the first capacitor to the driving unit. Achieve a high-low gray-scale switching by a lower data transmission efficiency to enhance an ability of high-low gray scale switching of the pixel driving circuit. Provide a first thin film transistor between the micro light emitting diode of the light emitting unit and the driving unit. The gate of the first thin film transistor is received the light emitting signal. The drain of the first thin film transistor is connected to the first end of the micro light emitting diode to ensure a current fluctuation of the driving unit not to affect the micro light emitting diode before lighting and to improve a display effect of a display device.

Furthermore, another embodiment of the disclosure provides a display device, including the pixel driving circuit abovementioned, and achieve a same technical effect of the pixel driving circuit in abovementioned embodiment.

The present disclosure has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A pixel driving circuit, comprising a data writing unit, a driving unit, a compensating unit, and a light emitting unit;

wherein the data writing unit is configured to receive a data voltage signal and a first scanning signal and connected to the driving unit through a first node;

wherein the driving unit is configured to receive a power high level signal and connected to the compensating unit through a second node;

wherein the light emitting unit is configured to receive a light emitting signal and a power low level signal and connected to the driving unit through a third node; and wherein the driving unit comprises a first capacitor, a first end of the first capacitor is configured to receive the power high level signal, a second end of the first capacitor is connected to the second node, the light emitting unit comprises a first thin film transistor and a micro light emitting diode, a gate of the first thin film transistor is configured to receive the light emitting signal, a source of the first thin film transistor is directly connected to the third node, and a drain of the first thin film transistor is directly connected to a first end of the micro light emitting diode;

wherein the data writing unit comprises a second thin film transistor, a gate of the second thin film transistor is configured to receive the first scanning signal, a source of the second thin film transistor is configured to receive the data voltage signal, and a drain of the second thin film transistor is directly connected to the first node;

wherein the driving unit further comprises a third thin film transistor and a storage capacitor, a gate of the third thin film transistor is connected to the first node, a source of the third thin film transistor is configured to receive the power high level signal, a drain of the third thin film transistor is connected to the third node, a first end of the storage capacitor is connected to the first node, and a second end of the storage capacitor is connected to the second node;

wherein the compensating unit is configured to receive a second scanning signal and connected to a sensing circuit, the sensing circuit is configured to provide a sensing voltage signal to transmit to the third thin film transistor by the compensating unit for sensing a threshold voltage of the third thin film transistor, and compensating the threshold voltage;

wherein the compensating unit comprises a fourth thin film transistor, a gate of the fourth thin film transistor is configured to receive the second scanning signal, a source of the fourth thin film transistor is directly connected to the sensing circuit, and a drain of the fourth thin film transistor is directly connected to the second node;

wherein a driving sequence of the pixel driving circuit comprises a first phase, a second phase, and a third phase; wherein the second thin film transistor and the fourth thin film transistor are turned on by the first scanning signal and the second scanning signal respectively, and the data voltage signal and the sensing voltage signal are written in the first phase; wherein the second thin film transistor and the fourth thin film transistor are turned off by the first scanning signal and the second scanning signal respectively, and the driving unit is under a capacitance coupling effect in the second phase; and wherein the third thin film transistor is turned on, the first thin film transistor is turned on by the light emitting signal, and the driving unit provides a driving current to drive the micro light emitting diode to emit light;

wherein all the first scanning signal, the second scanning signal, the data voltage signal, and the sensing voltage signal are high-level signals, and the light emitting signal is a low-level signal in the first phase; wherein all the first scanning signal, the second scanning signal, and the light emitting signal are the low-level signals, the data voltage signal comprises the high-level signal and the low-level signal, and the sensing voltage signal comprises the high-level signal and the low-level signal in the second phase; and wherein all the first scanning signal, the second scanning signal, the data voltage signal, and the sensing voltage signal are the low-level signals, and the light emitting signal are the high-level signals in the third phase.

2. The pixel driving circuit according to claim 1, wherein all the first thin film transistor, the second thin film transistor, the third thin film transistor, and the fourth thin film transistor are N type transistors.

3. The pixel driving circuit according to claim 1, wherein a sequence of the data voltage signal and a sequence of the sensing voltage signal are the same, and a sequence of the first scanning signal and a sequence of the second scanning signal are the same.

4. A display device, comprising a pixel driving circuit, wherein the pixel driving circuit comprises a data writing unit, a driving unit, a compensating unit, and a light emitting unit;

wherein the data writing unit is configured to receive a data voltage signal and a first scanning signal and connected to the driving unit through a first node;

wherein the driving unit is configured to receive a power high level signal and connected to the compensating unit through a second node;

wherein the light emitting unit is configured to receive a light emitting signal and a power low level signal and connected to the driving unit through a third node; and wherein the driving unit comprises a first capacitor, a first end of the first capacitor is configured to receive the power high level signal, a second end of the first capacitor is connected to the second node, the light emitting unit comprises a first thin film transistor and a micro light emitting diode, a gate of the first thin film transistor is configured to receive the light emitting signal, a source of the first thin film transistor is directly connected to the third node, and a drain of the first thin film transistor is directly connected to a first end of the micro light emitting diode;

wherein the data writing unit comprises a second thin film transistor, a gate of the second thin film transistor is configured to receive the first scanning signal, a source of the second thin film transistor is configured to receive the data voltage signal, and a drain of the second thin film transistor is directly connected to the first node;

wherein the driving unit further comprises a third thin film transistor and a storage capacitor, a gate of the third thin film transistor is connected to the first node, a source of the third thin film transistor is configured to receive the power high level signal, a drain of the third thin film transistor is connected to the third node, a first end of the storage capacitor is connected to the first node, and a second end of the storage capacitor is connected to the second node;

wherein the compensating unit is configured to receive a second scanning signal and connected to a sensing circuit, the sensing circuit is configured to provide a sensing voltage signal to transmit to the third thin film transistor by the compensating unit for sensing a threshold voltage of the third thin film transistor, and compensating the threshold voltage;

wherein the compensating unit comprises a fourth thin film transistor, a gate of the fourth thin film transistor is configured to receive the second scanning signal, a source of the fourth thin film transistor is directly connected to the sensing circuit, and a drain of the fourth thin film transistor is directly connected to the second node;

wherein a driving sequence of the pixel driving circuit comprises a first phase, a second phase, and a third phase; wherein the second thin film transistor and the fourth thin film transistor are turned on by the first scanning signal and the second scanning signal respectively, and the data voltage signal and the sensing voltage signal are written in the first phase; wherein the second thin film transistor and the fourth thin film transistor are turned off by the first scanning signal and the second scanning signal respectively, and the driving unit is under a capacitance coupling effect in the second phase; and wherein the third thin film transistor is turned on, the first thin film transistor is turned on by the light emitting signal, and the driving unit provides a driving current to drive the micro light emitting diode to emit light;

wherein all the first scanning signal, the second scanning signal, the data voltage signal, and the sensing voltage signal are high-level signals, and the light emitting signal is a low-level signal in the first phase; wherein all the first scanning signal, the second scanning signal, and the light emitting signal are the low-level signals, the data voltage signal comprises the high-level signal and the low-level signal, and the sensing voltage signal comprises the high-level signal and the low-level signal in the second phase; and wherein all the first scanning signal, the second scanning signal, the data voltage signal, and the sensing voltage signal are the low-level signals, and the light emitting signal are the high-level signals in the third phase.

5. The display device according to claim 4, wherein all the first thin film transistor, the second thin film transistor, the third thin film transistor, and the fourth thin film transistor are N type transistors.

6. The display device according to claim 4, wherein a sequence of the data voltage signal and a sequence of the sensing voltage signal are the same, and a sequence of the first scanning signal and a sequence of the second scanning signal are the same.

* * * * *